US006622456B2

(12) United States Patent
Almasy

(10) Patent No.: US 6,622,456 B2
(45) Date of Patent: Sep. 23, 2003

(54) METHOD AND APPARATUS FOR FILLING THE INNER SPACE OF INSULATING GLASS UNITS WITH INERT GASES

(75) Inventor: Joseph S. Almasy, South Russell, OH (US)

(73) Assignee: TruSeal Telenologies, Inc., Beachwood, OH (US)

( * ) Notice: Subject to any disclaimer, the term of this patent is extended or adjusted under 35 U.S.C. 154(b) by 99 days.

(21) Appl. No.: 09/993,728

(22) Filed: Nov. 6, 2001

(65) Prior Publication Data

US 2003/0097818 A1 May 29, 2003

(51) Int. Cl.[7] ..... E06B 3/24; B65B 31/00; B67C 3/00

(52) U.S. Cl. ..... 53/403; 52/171.3; 53/79; 141/5; 156/109; 428/34

(58) Field of Search ..... 53/79, 403, 467, 53/503, 504, 284.6; 141/5, 63; 428/34; 52/171.3; 156/109

(56) References Cited

U.S. PATENT DOCUMENTS 3,078,627 A * 2/1963 Dunipace et al.
3,683,974 A 8/1972 Stewart et al.
3,842,567 A * 10/1974 Zwart et al. ..... 53/403
3,940,898 A * 3/1976 Kaufman ..... 428/34
4,407,340 A 10/1983 Jensen et al.
4,780,164 A * 10/1988 Rueckheim et al. ..... 156/104
4,865,088 A 9/1989 Stearns
4,886,095 A * 12/1989 Lisec ..... 141/4
4,909,874 A * 3/1990 Rueckheim ..... 156/109
4,921,022 A 5/1990 Lisec
H975 H * 11/1991 Selkowitz et al. ..... 52/175
5,080,146 A * 1/1992 Arasteh ..... 141/4
5,110,337 A 5/1992 Lisec
5,390,406 A * 2/1995 Lisec ..... 53/503
5,735,318 A * 4/1998 Vianello ..... 53/403
5,792,523 A * 8/1998 McHugh, III ..... 428/34
6,182,715 B1 2/2001 Ziegler et al.

* cited by examiner

*Primary Examiner*—Stephen F. Gerrity
(74) *Attorney, Agent, or Firm*—Renner, Otto, Boisselle & Sklar LLP

(57) ABSTRACT

A method for filling insulating glass units with gases other than air by dispensing cryogenic liquids into the inner space of these units which then evaporates to the gaseous state. The method is more efficient and effective accomplishing acceptable gas concentrations in less time, than charging gases directly into the unit.

23 Claims, 3 Drawing Sheets

METHOD AND APPARATUS FOR FILLING THE INNER SPACE OF INSULATING GLASS UNITS WITH INERT GASES

BACKGROUND OF THE INVENTION

The present invention relates to a method for insulating glass windows, more particularly, to a method of filling the inner space of sealed insulating glass units with inert gas or mixture of gases.

Sealed insulating glass units typically consist of two parallel spaced apart lites of glass which are sealed along at their periphery such that the space between the lites, or the inner space, is completely enclosed. The inner space is typically filled with air. The transfer of energy through an insulating glass unit of this typical construction is reduced, due to the inclusion of the insulating layer of air in the inner space, as compared to a single lite of glass. The energy transfer may be further reduced by increasing the separation between the lites to increase the insulating blanket of air. There is a limit to the maximum separation beyond which convection within the air between the lites can increase energy transfer. The energy transfer may be further reduced by adding more layers of insulation in the form of additional inner spaces and enclosing glass lites. For example three parallel spaced apart lites of glass separated by two inner spaces and sealed at their periphery. In this manner the separation of the lites is kept below the maximum limit imposed by convection effects in the airspace, yet the overall energy transfer can be further reduced. If further reduction in energy transfer is desired then additional inner spaces can be added.

The energy transfer of sealed insulating glass units may be reduced by substituting the air in a sealed insulated glass window for a denser, lower conductivity gas. Suitable gases should be colorless, non-toxic, non-corrosive, non-flammable, unaffected by exposure to ultraviolet radiation, and denser than air, and of lower conductivity than air. Argon, krypton, xenon, and sulfur hexaflouride are examples of gases which are commonly substituted for air in insulating glass windows to reduce energy transfer.

A great variety of techniques have been developed for filling the inner space of insulating glass units with gas. Typically this is an exchange of gas, where the insulating glass unit originally contains air, present during the construction of the insulating glass units, which must be displaced or exchanged for the fill gas. It is desirable to achieve a high concentration of the fill gas in order to realize the maximum benefit of minimizing the energy transfer of the gas filled insulating glass unit. In practice the exchange of fill gas for air cannot be achieved without some mixing of the gases which results in a final concentration of the fill gas of less than 100%.

Several of the gas filling techniques make use of fact that all of the fill gases mentioned above are denser than air. One conventional technique involves the use of two probes. The first probe is used to feed the gas into the inner space and the second probe is used for exhausting air. The probes are inserted through bores provided in the sealing means at the periphery of the glass units. The bores in the sealing means must be sealed again after the gas exchange has been completed. The insulating glass unit is oriented such that the parallel spaced apart lites are vertical. The gas feeding probe is located at the bottom of the insulating glass unit and the exhausting probe is located near the top of the unit. This method is referred to here as the side filling method. The gas is introduced slowly into the inner space to minimize turbulent flow and to minimize mixing with the air in the inner space. The denser fill gas forces the less dense air towards the top of the airspace where it is exhausted at the exhaust probe. Some mixing with air will always occur and as such the volume of fill gas introduced is typically 1.75 to 2.00 times greater that the volume of the inner space. This over-filling is done in an attempt to also displace as much as possible of the fill gas air mixture such that a final concentration of greater than 90% fill gas is achieved.

In general a significant reduction in energy transfer may be realized for fill gas concentrations between 75% and 100%. However, the sealing means employed for insulating glass units typically have some low permeability which allows the fill gas to diffuse out of the inner space, due to the concentration gradient between the inner space and the ambient atmosphere, very slowly in service. To maintain the desired reduced level of energy transfer over the service life of the insulating glass unit the initial fill gas concentration is desired to be greater than 90% and is most desired to be greater than 95%. Depending on a number of factors associated with the overall design of the insulating glass unit and the edge sealing means the loss by diffusion of the fill gas may be limited such that the concentration of fill gas in the inner space may be maintained above 75% for 10–20 years or longer.

Another method, referred to here as the top filling method, involves orienting the insulating glass unit in the vertical position. Two bores are made in the top of the unit near opposite edges of the unit. A rigid or flexible tube for gas filling is inserted into the inner space and extends to the bottom of the unit along one side. The gas filling tube has multiple holes near the bottom of its length in order to minimize turbulent flow during filling. The tube is inserted into the inner space within two inches of the bottom of the unit. Fill gases, which are again denser than air, are charged through the tube to the bottom of the inner space. The fill gas displaces the air in a manner as described in the side filling method above. The volume of fill gas charged to the inner space is 1.75–2.00 times the volume of the inner space in order to also exhaust the volume of gas which has become partially mixed with air and achieve fill gas concentrations above 90%. The bores in the sealing means must be sealed again after the gas exchange has been completed.

The volume of fill gas to be charged in both of these methods may be calculated based on the size of the insulated glass units and adjusted for the amount of over-filling found through experience to give the typical desired final fill gas concentration. The fill volume is typically regulated by opening a valve in the fill gas supply line for a specified period of time while the gas is charged through a flow regulator set to a predetermined flow rate. Alternatively an oxygen analyzer may be attached to the exhaust port to monitor the oxygen content of the exhaust. The oxygen content is assumed to be proportional to the concentration of air in the mixture of fill gas and air in the exhaust from the inner space. The fill gas supply valve is turned off when the oxygen content in the exhaust falls below a level predetermined to provide the desired fill gas concentration. Using the oxygen analyzer means the size of the inner space to be filled need not be known and the volume of fill gas need not be calculated. Filling continues until the oxygen content, which is inversely proportional to the fill gas concentration, is less than the desired specification.

The maximum flow rate of fill gas into the insulated glass unit in both the side filling and the top filling methods is limited by 1) the desire to minimize turbulent flow, thereby minimizing mixing with the air in the unit; and by 2) the area of the of the exhaust bore or bores which will determine the back pressure within the inner space which if too high may damage the glass lites or the edge seal by forcing the glass lites apart. In general, for both the side filling and top filling method, a slow fill rate can achieve a high concentration of fill gas while limiting the amount of over-fill required. Faster filling rates can reduce the time required but will require higher over-fill rates to achieve the same final fill gas concentration. Even faster filling rates can cause so much turbulence and mixing of the fill gas with air in the inner space that desired fill gas concentrations cannot be achieved without using impractical over-filling amounts if at all.

Another method involves introducing a probe for gas exchange via an opening between the spacer frame and one of the glass units. This opening is produced by lifting and bending one glass lite at one comer so that it becomes partially separated from the edge sealing and spacing means. This is done by means of several suction cups attached to the lifted area while clamping other areas of the insulating glass unit. This means allows a high flow rate of fill gas as the opening for charging fill gas and exhausting the air can now be made large enough to mitigate pressure buildup. Air is withdrawn from the exhaust port. This technique is disadvantageous because there is an increased danger of breaking the stressed and displaced glass lite. A large amount of force is also necessary to lift the glass lite off the spacer frame. Due to the large opening shared by the charging and exhaust means a high level of over filling, 2.0 to 7.0 times the inner space volume, must be employed. This method lends itself to full automation of the filling process but does not significantly decrease the cycle time required.

These methods require more time to complete than the time required for the fabrication of the insulating glass unit prior to the gas filling step. Thus there must be an off line accumulation step to allow for gas filling in the production of insulating glass units. Multiple gas filling stations must be provided to allow filling of groups of units in order to maintain the desired overall production rate. Insulating glass units can be produced at a rate or cycle times between 20 to 60 seconds. Current rapid filling methods can achieve cycle times for the gas filling step of 40 to 120 seconds with significant over filling required to reach the desired fill gas concentration of greater than 90%. A faster gas filling method would overcome these problems to allow insulating glass units to be filled at the same rate as they are assembled. This would eliminate floor space, labor, and the need for multiple filling stations.

SUMMARY OF THE INVENTION

In accordance with the present invention, there is provided a method to efficiently and effectively fill the inner space of insulating glass units. The method comprises: positioning a glass unit, which has at least two sealingly connected outer walls spaced apart defining at least one inner space and at least one opening into the at least one inner space, at a selected position; charging a selected amount of at least one cryogenic liquid through the at least one opening into the at least one inner space of the glass unit; allowing the at least one cryogenic liquid to change into its gaseous state as it is warmed by the inner surfaces of the edge sealing means and glass at the bottom of the insulating glass unit, the increase in volume of the fill material as it changes from liquid to gas forces the air in the inner space above it out of the inner space; and sealing the at least one opening in the glass unit.

In the simplest embodiment of the present invention, the cryogenic liquid is suitably poured manually into the inner space using an insulated container and a funnel to direct the liquid through a small hole in the edge sealing means of the insulating glass unit. The desired amount of liquid is suitably pre-measured volumetrically. The liquid is allowed to boil and/or evaporate in the inner space forcing the lighter air out, and the opening is sealed.

In a preferred embodiment of the present invention, the cryogenic liquid is dispensed into the inner space by a specially designed cryogenic liquid dosing machine. The machine has volumetric sensing aspects which sense the length and width of the glass units and the separation of the outer walls defining the inner space. The dosing machine calculates the amount of cryogenic liquid required.

The method of filling the inner space of insulating glass units with cryogenic liquid allows the insulating glass units to be filled more quickly, thus cycle times customary for insulating glass manufacture can be maintained. Additionally, even windows containing grids between the window panes can be filled more quickly. In conventional gas fill methods, the grids tend to cause more turbulence during the gas fill process. Whereas, the method of the present invention allows for accelerated gas fill without these turbulent effects. Overall, the method accelerates the gas-filling process and reduces the waste and turbulent effects normally associated with the quickest conventional gas-fill methods.

These and other aspects of the invention are herein described with reference to the accompanying Figures which are representative of various embodiments in which the principles and concepts of the invention can be embodied.

DETAILED DESCRIPTION OF PREFERRED AND ALTERNATE EMBODIMENTS

The invention provides a method of insulating windows by filling the inner space of the windows with fill gases, such as argon, krypton, xenon, sulfur hexaflouride, carbon dioxide, nitrogen, and liquid atmospheric air, wherein these substances are introduced into the inner space in their cryogenic liquid state and then allowed to boil or evaporate into the gaseous state, which accelerates the filling process and reduces the waste and turbulent effects normally associated with the quickest conventional gas-fill methods.

The method of the present invention has accelerated the gas-filling process. This method provides for fast, serial insulating glass fabrication and gas-filling processes, achieving filling times of 15 seconds per glass unit while still producing about 90% fill gas concentrations. The method allows a manufacturer to keep pace with today's expected throughput. In contrast, even the quickest conventional gas-fill methods only achieve dosing times of 60 to 120 seconds per glass unit to produce such a fill gas concentration.

This accelerated method comprises the steps of first positioning the insulated glass units 7 vertically and at about a 7 degree incline from vertical, such that the opening is located at the top of the glass unit. A dispensing head 10 is positioned proximate to the opening of the glass unit 7. Cryogenic liquid is dispensed into the space between the glass units and allowed to evaporate completely. The opening in the edge seal and/or spacer is sealed by any suitable means.

Figure 1:
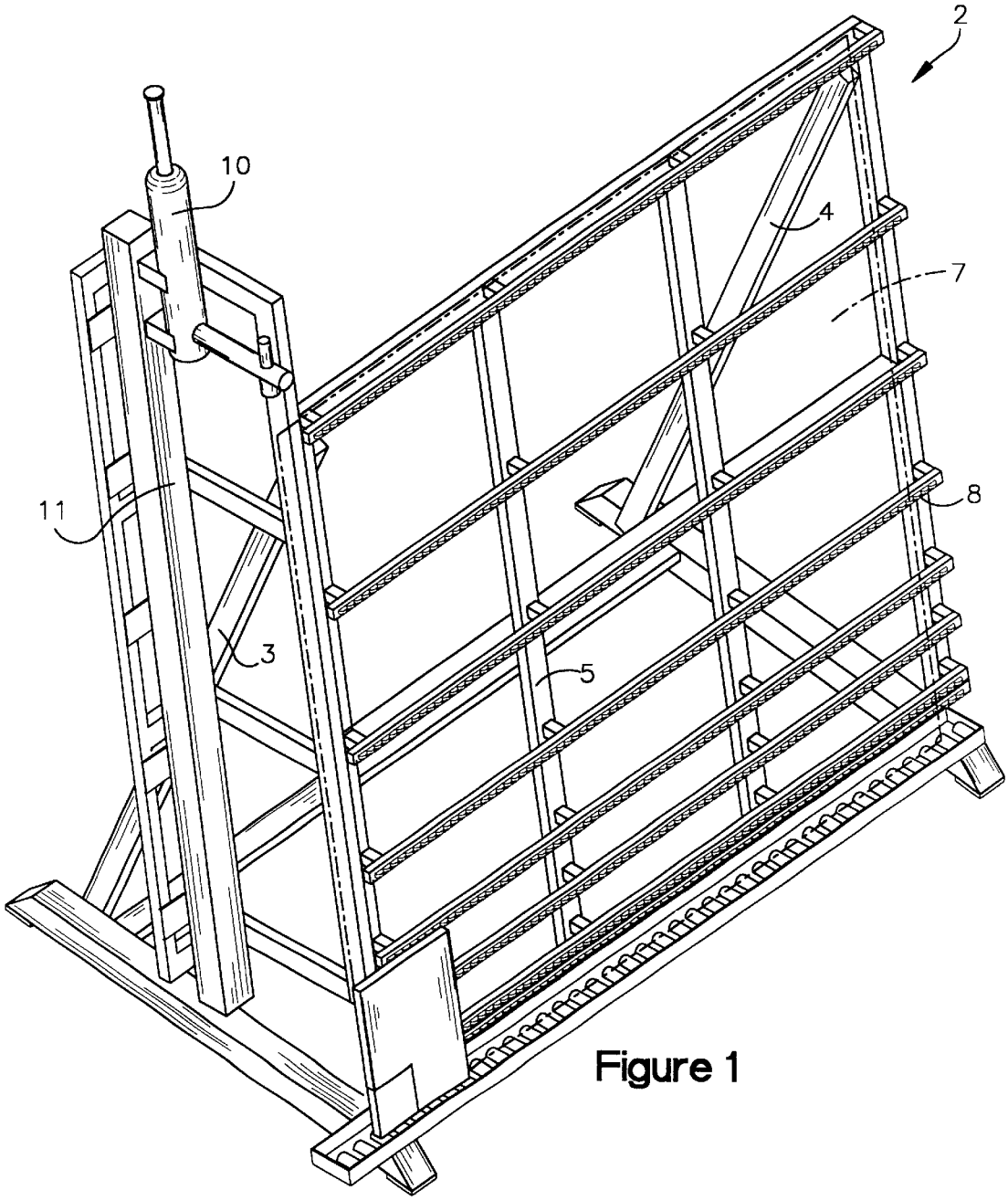
FIG. 1 is a perspective view of the insulating glass unit support frame used in the present invention.

As shown in FIG. 1, the method of the present invention utilizes an insulating glass unit support frame 2 for supporting the glass units 7. Side supports 3 and 4 act to maintain the glass units 7 in a vertical position. The positioning of the glass units 7, allows gravity to act on the cryogenic liquid, pulling it to the bottom. It is also advantageous to decline the insulating glass unit 5 to 10 degrees from the vertical such that the bottom of a rectilinear unit remains parallel with the ground but such that the liquid dispensed into the unit contacts one of the glass lites prior to falling to the bottom of the inner space. If the insulating glass unit is non-rectilinear, it is positioned 5 to 10 degrees from the vertical such that the cryogenic liquid will not flow into one comer of the glass unit. Therefore, back supports 5 and front supports 8 allow the glass units 7 to be placed at a slight incline with the open comer situated at the top. This contact with the glass lite provides yet another mechanism to rapidly warm the liquid, hence speeding evaporation.

Figure 2:
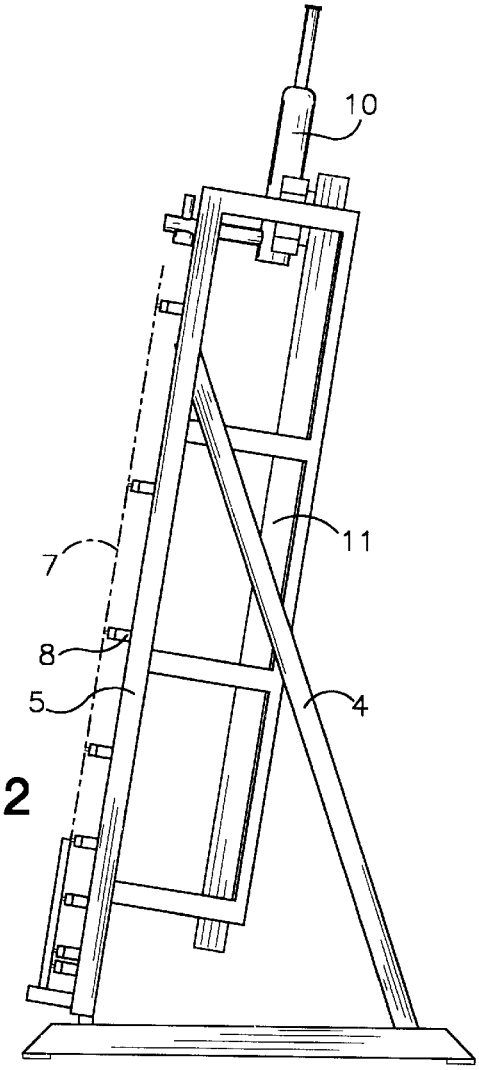
FIG. 2 is a side view of the insulating glass unit support frame used in the present invention.

FIG. 2 also illustrates the insulating glass unit support frame 2. A dispensing head 10 is supported by a dispenser stand 11. The stand 11 is attached to side support 3 of the insulating glass unit support frame 2. The stand 11 allows for up and down movement of the dispensing head 10. Thus, the dispensing head 10 is suitably adjusted to accommodate glass units 7 of varying heights. This adjustability allows the method of the present invention to be used with any size or configuration type of insulating glass unit.

Figure 4:
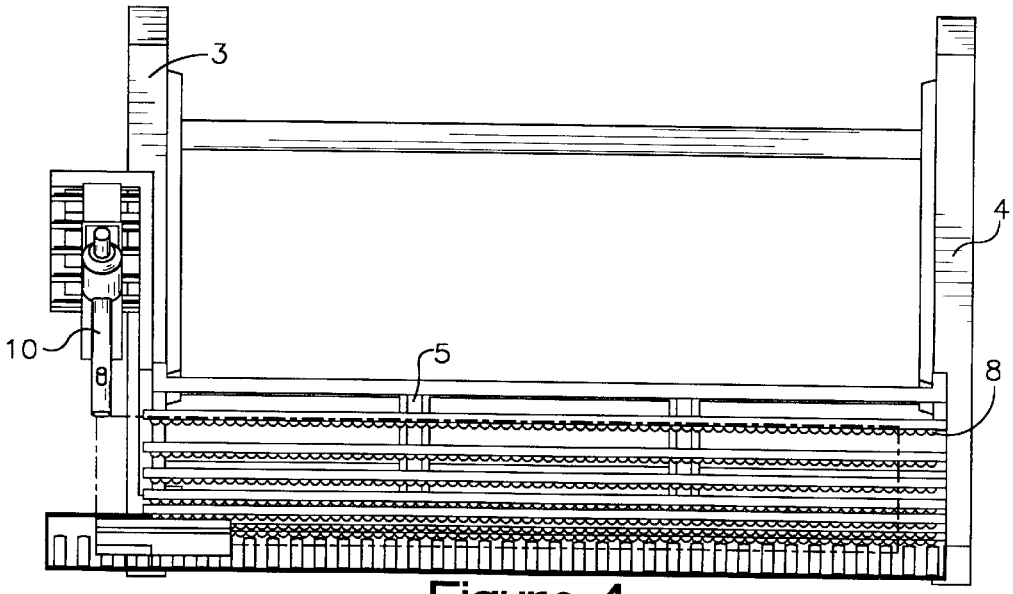
FIG. 4 is a top view of the insulating glass unit support frame used in the present invention.
Figure 3:
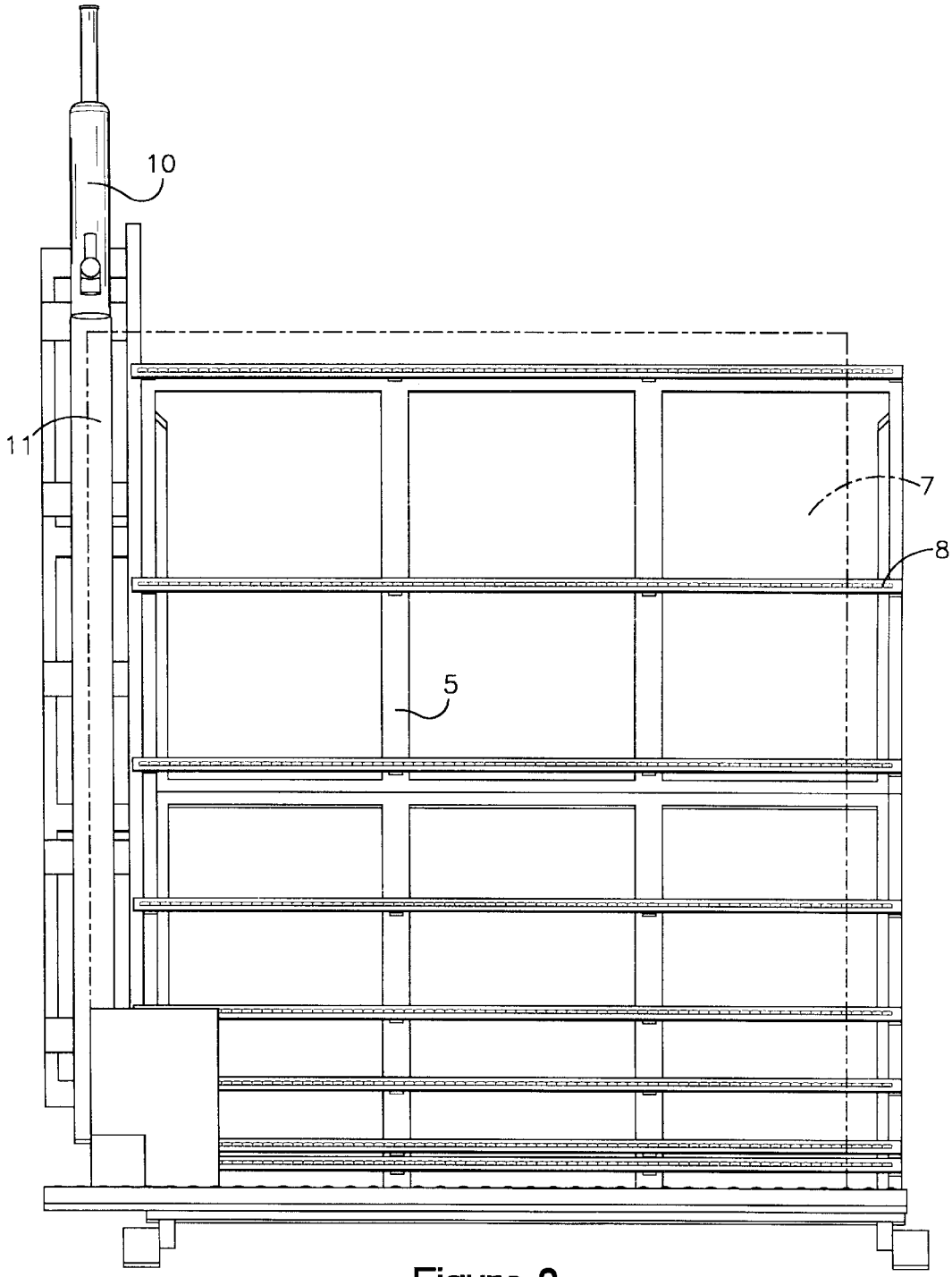
FIG. 3 is a front view of the insulating glass support frame used in the present invention.

FIGS. 3 and 4 depict front and top views respectively, of the insulating glass unit support frame 2. Dispensing head 10 is inserted into or positioned over the open corner of the glass units 7. Once in place, the dispensing head 10 then releases a specific amount of cryogenic liquid which quickly falls to the bottom of the glass units 7, due to gravity. The cryogenic liquid then boils and/or evaporates into its gaseous state, displacing the lighter, moist air which exits via the top edge's perimeter vent. The cryogenic liquid spread across the bottom of the glass unit boils and/or evaporates and expands uniformly, displacing the lighter air from the bottom. The recently boiled/evaporated fill gas remains significantly colder and so much denser than air. Therefore, the heavier fill gas fills from the bottom-up, with very low turbulence. The evaporation of the liquid naturally creates less turbulence and waste than conventional gas-fill methods.

Once the cryogenic liquid has completely boiled/evaporated or changed into a gaseous state, the opening in the unit is sealed. The unit is typically not to be sealed until the cryogenic liquid has completely evaporated, unlike the use of liquid nitrogen in the food industry. In the food industry, a few drops of liquid nitrogen are placed into non-carbonated beverage containers and then sealed before evaporation. The evaporation of the liquid nitrogen pressurizes the containers. This build-up of pressure strengthens plastic containers, allowing them to be stacked on top of each other. However, in the present invention, if the unit is sealed before the cryogenic liquid has completely evaporated, the build-up of pressure created inside may destroy the glass unit's seal. Thus, it is extremely important that the liquid argon completely evaporate before sealing the glass unit.

In an alternative embodiment, the pressure within an insulated glass unit is increased to compensate for a decrease in altitude between the manufacturing location and the installation location. The desired increase in pressure may be achieved by a second smaller dosing of cryogenic liquid after the first dose has evaporated. The dosing opening is sealed immediately after the second dosing of cryogenic liquid to allow the desired slight build-up of pressure in the glass units.

In a preferred embodiment of the present invention, the cryogenic liquid form of the fill gas is dispensed into the inner space by a liquid dosing machine, not shown. The machine comprises a supply conduit connected to standard liquid-gas cylinders filled with liquid. These cylinders supply cryogenic liquid to the dosing machine. Additionally, a vacuum-insulated cryogenic liquid reservoir is connected through a flexible conduit to the dispensing head 10. The dispensing head 10 is supported by a stand 11, which is attached to the insulated glass unit support 2. The stand 11 retains the dispensing head 10 in position. However, the dispensing head 10 also has an attachment means that allows it to move up and down. Thus, the dispensing head 10 is suitably adjusted to accommodate glass units 7 of varying heights.

Once the dispensing head 10 is in position, cryogenic liquid is dispensed into the inner space. The liquid is warmed by contact with the surfaces at the bottom of the inner space of the insulating glass unit and quickly boils and/or evaporates to become the fill gas. This gas is denser than the air in the unit which is displaced upwards and out of the one or two openings at the top of the insulating glass unit. The openings are then sealed when the liquid is completely evaporated. Assuming the insulating glass unit is rectilinear, the rate of evaporation of the liquid is increased by keeping the bottom side of the insulating glass unit parallel to the ground, allowing the liquid to spread out over the largest area for maximum contact with the bottom of the inner space and thus maximum heat transfer and warming of the liquid. The rate of evaporation may be further increased by positioning heat lamps outside the insulating glass unit such that the edge sealing means and the bottom portion of the glass lites are warmed prior to or during the dosing time.

Last, the required amount of liquid to be dispensed is suitably communicated to the dispensing equipment in several ways. In one embodiment, the volume is sent via data communication from another part of the insulating glass manufacturing system where the volume required for the specific insulating glass unit to be filled has been calculated by knowing the size of the glass lites and the separation of the lites. The size and separation of the lites was already known in order to build the unit. This method requires that other precautions be taken to ensure that the data sent to liquid dispensing station matches the unit to be filled. The alternative method of determining the volume to be dispensed is to provide the dispensing system with a means of sensing the dimensions of the lites and the separation of the lites for each insulating glass unit, at the time it reaches the filing station, and calculating the volume of liquid required in the liquid dosing system. In this manner the need for synchronizing data between the liquid dispensing system and other parts of the insulating glass manufacturing system is eliminated, while the volume of liquid required is still determined automatically.

The preferred embodiment is suitably further enhanced by adding means to automatically move insulating glass units into position for filling with liquid and automatically sealing the unit after filling, and automatically moving the unit away.

In another embodiment, the liquid is dispensed into the inner space through use of a dewar and a funnel. A funnel is inserted directly into the open corner of the glass units 7. A specified amount of liquid is then poured directly from the dewar into the funnel. The liquid falls to the bottom of the glass units 7 and then boils and/or evaporates into its gaseous state. Once the liquid has completely evaporated, the open corner of the glass unit is sealed.

Multiple tests were conducted based on the above mentioned embodiments. The tests, which are set forth below, focused on filling the inner space of the insulating glass units with argon.

EXAMPLE I

In this example, the manual measure and pour method was used. As described above, this method involved inserting a funnel into the opening of the insulated glass units. Then, pouring a specified amount of liquid argon into the funnel and allowing this amount of liquid argon to evaporate. The results of this example are contained in Table I.

TABLE I

Liquid Argon Filling Test - Manual Measure and Pour Method
7/16" Pane separation

| Size Inches | Dose cc | Dose Volume[1] | Flash Time seconds | Actual Fill[2] |
|---|---|---|---|---|
| 24" × 48" | 12.5 | 1.2 | 22 | 94.6% |
| 24" × 48" | 25.0 | 2.4 | 24 | 90.2% |
| 24" × 48" | 12.5 | 1.2 | 29 | 88.8% |
| 24" × 48" | 12.5 | 1.2 | 24 | 92.4% |

EXAMPLE II

In this example, the cryogenic liquid dosing machine was used. As described above, this method involved positioning a dispensing head proximate to the opening of the insulated glass units. Then, dispensing a specified amount of liquid argon via the dispensing head into the inner space of the insulated glass units and allowing this amount of liquid argon to evaporate. The results of this example are contained in Table II.

TABLE II

Liquid Argon Filling Test - Cryogenic Liquid Dispensing Equipment
3/8" Pane separation

| Size Inches | Dose Time seconds | Dose Volume[1] As a gas | Flash Time seconds | Grids | Actual Fill[2] |
|---|---|---|---|---|---|
| 22 × 36 | 5.078 | 2.0 | 15.73 | N | 91.6 |
| 36 × 22 | 5.078 | 2.0 | 15.79 | N | 92.8 |
| 22 × 36 | 5.078 | 2.0 | — | N | 92.8 |
| 22 × 36 | 5.078 | 2.0 | 14.25 | N | 90.6 |
| 36 × 22 | 5.078 | 2.0 | 16.93 | Y | 95.6 |
| 36 × 22 | 5.078 | 2.0 | 15.13 | N | 92.3 |
| 27.5 × 70.75 | 12.474 | 2.0 | 14.5 | Y | 95.2 |
| 27.5 × 70.75 | 12.474[3] | 2.0 | — | Y | 97.6 |

[1]Expressed in units where 1.0 is equal to 1 volume of the unit to be filled.
[2]Measured by Oxygen Anlayzer
[3]3 separate doses applied for a total dose time as indicated It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art of designing and manufacturing insulating glass or skilled in the art of handling and dispensing cryogenic liquids upon reading and comprehending this disclosure. Such features, aspects, and expected variations and modifications of the reported results and examples are clearly within the scope of the invention where the invention is limited solely by the scope of the following claims.

What is claimed is:

1. A method of gas filling insulating glass units wherein the insulating glass unit has at least two sealingly connected outer walls spaced apart defining at least one inner space and at least one opening into the at least one inner space, the method comprising:

charging a selected amount of at least one cryogenic liquid through the at least one opening into the at least one inner space of the glass unit;

allowing the at least one cryogenic liquid to change into its gaseous state; and sealing the at least one opening in the glass unit.

2. A method of gas filling insulating glass units according to claim 1 wherein the glass unit is sealed after the at least one cryogenic liquid completely changes into its gaseous state.

3. A method of gas filling insulating glass units according to claim 1 wherein the glass unit is sealed before the at least one cryogenic liquid completely changes into its gaseous state.

4. A method of gas filling insulating glass units according to claim 1 wherein the glass unit is positioned vertically and at about a 7 degree incline from vertical, such that the at least one opening is located at the top of the glass unit.

5. A method of gas filling insulating glass units according to claim 1 wherein the at least one cryogenic liquid is charged via a dispensing head positioned proximate to the at least one opening of the insulated glass unit.

6. A method of gas filling insulating glass units according to claim 5 wherein the dispensing head is inserted into the at least one opening of the insulated glass unit.

7. A method of gas filling insulating glass units according to claim 5 wherein the dispensing head is positioned over the at least one opening of the insulated glass unit.

8. A method of gas filling insulating glass units according to claim 1 wherein the at least one cryogenic liquid is charged via a funnel positioned in the opening of the insulated glass unit.

9. A method of gas filling insulated glass units according to claim 8 wherein the funnel is inserted directly into the at least one opening of the glass unit.

10. A method of gas filling insulated glass units according to claim 9 wherein a specific amount of the at least one cryogenic liquid is poured directly into the funnel.

11. A method of gas filling insulated glass units according to claim 1 wherein the cryogenic liquid is selected from the group consisting of argon, krypton, xenon, sulfur hexaflouride, carbon dioxide, nitrogen, liquid atmospheric air, and combinations thereof.

12. A method of gas filling insulated glass units according to claim 1 wherein the at least one cryogenic liquid evaporates into its gaseous state.

13. A method of gas filling insulated glass units according to claim 1 wherein the at least one cryogenic liquid boils into its gaseous state.

14. A method of gas filling insulated glass units according to claim 1 wherein the at least one cryogenic liquid is charged into the inner space using a liquid dosing machine.

15. A method of gas filling insulated glass units according to claim 14 wherein the liquid dosing machine is connected through a flexible conduit to a dispensing head.

16. A method of gas filling insulated glass units according to claim 15 wherein the dispensing head is vertically adjustable to accommodate glass units of varying height.

17. A method of gas filling insulated glass units according to claim 14 wherein the liquid dosing machine has volumetric sensing aspects which calculate the length and width of the glass units and the separation of the outer walls defining the inner space and calculate the exact amount of cryogenic liquid required.

18. A system for gas filling insulated glass units wherein the insulating glass unit has at least two sealingly connected outer walls spaced apart defining at least one inner space and at least one opening into the at least one inner space, the system comprising:

means adapted for charging a selected amount of at least one cryogenic liquid through the at least one opening into the at least one inner space of the glass unit;

means adapted for allowing the at least one cryogenic liquid to change into its gaseous state; and means adapted for sealing the at least one opening in the glass unit.

19. A system for gas filling insulated glass units according to claim 18 wherein the means adapted for charging the cryogenic liquid is a dispensing head positioned proximate to the opening of the insulated glass unit.

20. A system for gas filling insulated glass units according to claim 18 wherein the means adapted for charging cryogenic liquid is a funnel positioned in the opening of the insulated glass unit.

21. An automated machine for gas filling insulated glass units wherein the glass unit has at least two sealingly connected outer walls spaced apart defining at least one inner space and at least one opening into the at least one inner space, the machine comprising:

cryogenic liquid dispensing means;

a dispensing head for dispensing cryogenic liquid, wherein the dispensing head is vertically adjustable and is connected to the cryogenic liquid dispensing means;

a means adapted for sensing the length and width of the glass units and the separation of the outer walls defining the inner space, so as to calculate the cryogenic liquid volume required and connected to at least one of the dispensing head and the cryogenic liquid dispensing means; and a means adapted for positioning the glass units in a vertical or near vertical position.

22. An automated machine for gas filling insulated glass units according to claim 21 further comprising a means adapted for automatically moving the glass units to and from the machine.

23. An automated machine for gas filling insulated glass units according to claim 21 further comprising a means adapted for automatically sealing the at least one opening of the glass unts.

* * * * *